US006234257B1

(12) United States Patent
Ciglenec et al.

(10) Patent No.: US 6,234,257 B1
(45) Date of Patent: May 22, 2001

(54) DEPLOYABLE SENSOR APPARATUS AND METHOD

(75) Inventors: Reinhart Ciglenec; Lennox E. Reid, both of Houston, TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/293,859

(22) Filed: Apr. 16, 1999

Related U.S. Application Data

(63) Continuation-in-part of application No. 09/019,466, filed on Feb. 5, 1998, now Pat. No. 6,028,534.
(60) Provisional application No. 60/048,254, filed on Jun. 2, 1997.

(51) Int. Cl.[7] ..... E21B 47/00
(52) U.S. Cl. ..... 175/50; 166/250.01; 73/152.54; 73/152.46
(58) Field of Search ..... 175/40, 50, 457; 166/250.02, 252.2, 252.5, 254.2, 250.16, 250.01; 73/152.54, 152.46; 340/853.1, 853.3, 853.8, 854.6; 324/329, 332, 338, 353, 356, 366

(56) References Cited

U.S. PATENT DOCUMENTS

| | | | | |
|---|---|---|---|---|
| 2,559,687 | * | 7/1951 | Thomas, Jr. | 175/4.57 |
| 2,672,195 | * | 3/1954 | Allen | 175/4.57 |
| 3,528,000 | | 9/1970 | Schwede . | |
| 3,934,468 | | 1/1976 | Brieger . | |
| 4,860,581 | | 8/1989 | Zimmerman et al. . | |
| 4,893,505 | | 1/1990 | Marsden et al. . | |
| 4,936,139 | | 6/1990 | Zimmerman et al. . | |
| 5,065,619 | | 11/1991 | Myska . | |
| 5,165,274 | * | 11/1992 | Thiercelin | 73/151 |
| 5,195,588 | | 3/1993 | Dave . | |
| 5,622,223 | | 4/1997 | Vasquez . | |
| 5,692,565 | | 12/1997 | Mac Dougall et al. . | |
| 5,765,637 | * | 6/1998 | Dietle et al. | 166/155 |
| 6,070,662 | * | 6/2000 | Ciglenec et al. | 166/254.1 |
| 6,097,668 | * | 6/1998 | Hopkins | 367/4 |

FOREIGN PATENT DOCUMENTS

| | | | | |
|---|---|---|---|---|
| 0 361 805 A1 | | 4/1990 | (EP) . | |
| 0 882 871 A2 | | 12/1998 | (EP) . | |
| 0 882 871 A3 | | 5/1999 | (EP) . | |
| 0 984 135 A2 | | 3/2000 | (EP) . | |
| 567993 | * | 8/1977 | (SU) | 73/152.54 |
| WO 88/06739 | * | 9/1988 | (WO) . | |

OTHER PUBLICATIONS

European Patent Office, *European Search Report* dated Jun. 2, 2000.
"Penetrator and Dart NMR Probes," *NASA Tech Briefs*, pp. 56 & 58 (May 1997).

* cited by examiner

*Primary Examiner*—Thomas B. Will
*Assistant Examiner*—Nathan Mammen
(74) *Attorney, Agent, or Firm*—John. J. Ryberg; Steven L. Christian

(57) ABSTRACT

An apparatus and method are provided for gathering data from a subsurface formation. A shell is utilized having a chamber therein, and being adapted for sustaining forcible propulsion into the subsurface formation. A data sensor is disposed within the chamber of the shell. The shell has a first port therein for communicating properties of a fluid present in the subsurface formation to the data sensor when the apparatus is positioned in the subsurface formation, whereby the data sensor senses at least one of the properties of the fluid.

26 Claims, 6 Drawing Sheets

DEPLOYABLE SENSOR APPARATUS AND METHOD

CROSS-REFERENCE TO RELATED APPLICATIONS

This application is a continuation-in-part of U.S. patent application Ser. No. 09/019,466, filed on Feb. 5, 1998, now U.S. Pat. No. 6,028,534 issued Feb. 22, 2000 which claims priority to U.S. Provisional Application No. 60/048,254 filed on Jun. 2, 1997.

BACKGROUND OF THE INVENTION

1. Field of the Invention

This invention relates generally to the determination of various parameters in a subsurface formation penetrated by a wellbore, and, more particularly, to such determination by means of a remotely deployed sensor.

2. Description of the Related Art

Present day oil well operation and production involves continuous monitoring of various subsurface formation parameters. One aspect of standard formation evaluation is concerned with the parameters of reservoir pressure and the permeability of the reservoir rock formation. Continuous monitoring of parameters such as reservoir pressure and permeability indicate the formation pressure change over a period of time, and is essential to predict the production capacity and lifetime of a subsurface formation. Present day operations obtain these parameters either through wireline logging via a "formation tester" tool or through drill stem tests. Both types of measurements are available in "open-hole" or "cased-hole" applications, and require a supplemental "trip", in other words, removing the drill string from the wellbore, running a formation tester into the wellbore to acquire the formation data and, after retrieving the formation tester, running the drill string back into the wellbore for further drilling. Thus, it is typical for formation parameters, including pressure, to be monitored with wireline formation testing tools, such as those tools described in U.S. Pat. Nos.: 3,934,468; 4,860,581; 4,893,505; 4,936,139; and 5,622,223.

The '468 patent, assigned to Schlumberger Technology Corporation, the assignee of the present invention, describes an elongated tubular body that is disposed in an uncased wellbore to test a formation zone of interest. The tubular body has a sealing pad which is urged into sealing engagement with the wellbore at the formation zone by secondary well-engaging pads opposite the scaling pad and a series of hydraulic actuators. The body is equipped with a fluid admitting means, including a movable probe, that communicates with and obtains samples of formation fluids through a central opening in the sealing pad. Such fluid communication and sampling permits the collection of formation parameter data, including but not limited to formation pressure. The movable probe of the '468 patent is particularly adapted for testing formation zones exhibiting different and unknown competencies or stabilities.

The '581 and '139 patents, also assigned to the assignee of the present invention, disclose modular formation testing tools that provide numerous capabilities, including formation pressure measurement and sampling, in uncased wellbores. These patents describe tools that are capable of taking measurements and samples at multiple formation zones in a single trip of the tool.

The '505 patent, assigned to Western Atlas International, Inc., similarly discloses a formation testing tool capable of measuring the pressure and temperature of the formation penetrated by an uncased wellbore, as well as collecting fluid samples, at a plurality of formation zones.

The '223 patent, assigned to Halliburton Company, discloses another wireline formation testing tool for withdrawing a formation fluid from a zone of interest in an uncased wellbore. The tool utilizes an inflatable packer, and is said to be operable for determining in situ the type and the bubble point pressure of the fluid being withdrawn, and for selectively collecting fluid samples that are substantially free of mud filtrates.

The tools and methods described in the '468, '581, '139, '505, and '223 patents mentioned above are not intended for use in cased wellbores, and are generally not permanently connected to the wellbore or formation. However, formation testing tools and methods that are intended for use in cased wellbores are well known in the art, as exemplified by U.S. Pat. Nos.: 5,065,619; 5,195,588; and 5,692,565.

The '619 patent, assigned to Halliburton Logging Services, Inc., discloses a means for testing the pressure of a formation behind casing in a wellbore that penetrates the formation. A "backup shoe" is hydraulically extended from one side of a wireline formation tester for contacting the casing wall, and a testing probe is hydraulically extended from the other side of the tester. The probe includes a surrounding seal ring which forms a seal against the casing wall opposite the backup shoe. A small shaped charge is positioned in the center of the seal ring for perforating the casing and surrounding cement layer, if present. Formation fluid flows through the perforation and seal ring into a flow line for delivery to a pressure sensor and a pair of fluid manipulating and sampling tanks.

The '588 patent, also assigned to the assignee of the present invention, improves upon the formation testers that perforate the casing to obtain access to the formation behind the casing by providing a means for plugging the casing perforation. More specifically, the '588 patent discloses a tool that is capable of plugging a perforation while the tool is still set at the position at which the perforation was made. Timely closing of the perforation(s) by plugging prevents the possibility of substantial loss of wellbore fluid into the formation and/or degradation of the formation. It also prevents the uncontrolled entry of formation fluids into the wellbore, which can be deleterious such as in the case of gas intrusion.

The '565 patent, also assigned to Schlumberger Technology Corporation, describes a further improved apparatus and method for sampling a formation behind a cased wellbore, in that the invention uses a flexible drilling shaft to create a more uniform casing perforation than with a shaped charge. The uniform perforation provides greater reliability that the casing will be properly plugged, because shaped charges result in non-uniform perforations that can be difficult to plug, often requiring both a solid plug and a non-solid sealant material. Thus, the uniform perforation provided by the flexible drilling shaft increases the reliability of using plugs to seal the casing. Once the casing perforations are plugged, however, there is no means of communicating with the formation without repeating the perforation process. Even then, such formation communication is possible only as long as the formation tester is set in the wellbore and the casing perforation remains open.

Each of the aforementioned patents is therefore limited in that the formation testing tools described therein, whether for use in open or cased holes, are only capable of acquiring formation data as long as the wireline tools are disposed in the wellbore and in physical contact with the formation zone of interest. Since "tripping the well" to use such formation testers consumes significant amounts of expensive rig time, it is typically done under circumstances where the formation data is absolutely needed or it is done when tripping of the drill string is done for a drill bit change or for other reasons.

During well drilling activities, the availability of reservoir formation data on a "real time" basis is a valuable asset. Real time formation pressure obtained while drilling will allow a drilling engineer or driller to make decisions concerning changes in drilling mud weight and composition as well as penetration parameters at a much earlier time to thus promote the safety aspects of drilling. The availability of real time reservoir formation data is also desirable to enable precision control of drill bit weight in relation to formation pressure changes and changes in permeability so that the drilling operation can be carried out at its maximum efficiency.

It is desirable therefore to provide a method and apparatus for well drilling that enable the acquisition of various formation data from a subsurface zone of interest while the drill string with its drill collars, drill bit and other drilling components are present within the well bore, thus eliminating or minimizing the need for tripping the well drilling equipment for the sole purpose of running formation testers into the wellbore for identification of these formation parameters.

It is a further object of the present invention to provide a rugged structure for intelligent data sensors that are adapted for deployment into the formation, whereby the sensors may be reliably exposed to high g-forces during the deployment process with an expectation of survival and continuous functional integrity.

It is a further object of the present invention to provide a structure for such sensors, whereby the sensors may be reliably exposed to the high pressures and temperatures of an ignition-induced propulsive force during deployment.

It is a further object to provide and apparatus and method of operating such sensors, whereby the sensors are adapted to survive the launch from a gun-like deployment mechanism without deformation, damage, or failure.

It is still a further object to provide an apparatus and method of operating such sensors, whereby the sensors survive impact in a subsurface rock formation without deformation, damage, or failure.

It is still a further object to provide an apparatus and method of operating such sensors, whereby the sensors achieve substantially linear penetration to a satisfactory depth in the formation.

It is still a further object to provide an apparatus and method of operating such sensors, whereby the sensors are capable of radio frequency communication through the rock formation.

SUMMARY OF THE INVENTION

The objects described above, as well as various other objects and advantages, are achieved by an apparatus for gathering data from a subsurface formation, including a shell having a chamber therein and adapted for sustaining forcible propulsion into a subsurface formation. A data sensor is disposed within the chamber of the shell. The shell has a first port therein for communicating properties of a fluid present in the subsurface formation to the data sensor when the apparatus is positioned in the subsurface formation, whereby the data sensor senses at least one of the properties of the fluid.

In a preferred embodiment, the shell is substantially bullet-shaped, and includes a nose section substantially constructed of a first material and a rear section substantially constructed of a second material. In a particularly preferred embodiment, the first material is a tungsten alloy and the second material is a zirconia-based ceramic. The nose section of the shell is adapted for ensuring survival of the apparatus without functional failure during deployment into the formation. The rear section of the shell is adapted for protecting components disposed within the chamber in the shell from high temperatures and pressures encountered during at least one method of deploying of the apparatus. The shell is split along a first plane perpendicular to its longitudinal axis into the nose section and rear section, each of which has opposing cavities that cooperate to form the chamber in the shell when the nose and rear sections are connected. In a particularly preferred embodiment, the shell is further adapted for sustaining g-forces of at least 85,000 g's along its longitudinal axis during deployment of the apparatus.

The preferred embodiment also includes a capsule disposed within the chamber of the shell for carrying the data sensor and associated electronics. The capsule extends from the chamber in the nose section into the chamber in the rear section, whereby the capsule spans the first plane and integrates the nose and rear sections of the shell. The capsule is split along a second plane that includes the capsule's longitudinal axis to facilitate placement of the data sensor therein, and is at least partially constructed of a titanium alloy. The capsule is further equipped with a second port therein and is disposed within the chamber of the shell so as to position the second port adjacent the first port, enabling communication of the formation fluid properties through the first and second ports to the data sensor when the apparatus is positioned in the subsurface formation.

The data sensor is preferably adapted for sensing at least formation pressure and temperature. A number of discrete sensors may be disposed in the capsule for sensing various other formation parameters.

The preferred embodiment further includes an antenna disposed within the shell chamber for transmitting signals representative of the fluid property or other formation property sensed by the data sensor, and for receiving signals from a remote source to activate the data sensor. The antenna is preferably disposed in the rear portion of the chamber and the data sensor is disposed in the forward portion of the chamber within the capsule.

The present invention may be further summarized as a method of determining a property of a subsurface formation. A shell is equipped with a sensor for indicating a property of a subsurface formation and an antenna for transmitting a signal representative of the sensor-indicated property. The shell has a port therein for communicating properties of the fluid present in the subsurface formation to the sensor when the shell is inserted into the subsurface formation. The shell is positioned within a downhole tool disposed in a wellbore penetrating the subsurface formation. Force is applied from the downhole tool to move the shell from the drill string into the subsurface formation. At least one formation property is then sensed with the sensor, and a signal representative of the formation property is transmitted from the shell with the antenna.

The present invention may be still further summarized by a method including the steps of equipping a substantially bullet-shaped shell with a sensor for indicating a property of a subsurface formation, a receiver for receiving remotely transmitted signals, and a transmitter for transmitting a signal representative of the sensor-indicated property. The shell has a port therein for communicating properties of the fluid present in the subsurface formation to the sensor when the shell is inserted into the subsurface formation. The shell is positioned within a drill string disposed in a wellbore penetrating the subsurface formation. Force is applied from the drill string to move the shell from the drill string into the subsurface formation. The sensor is activated with a remote signal transmitted to the receiver, and a formation property is sensed with the sensor. A signal representative of the formation property is then transmitted with the transmitting means.

The force applied to the shell may be either an ignition-induced propulsive force, a mechanical force, or any other appropriate force.

BRIEF DESCRIPTION OF THE DRAWING(S)

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

DETAILED DESCRIPTION OF THE INVENTION

Figure 1:
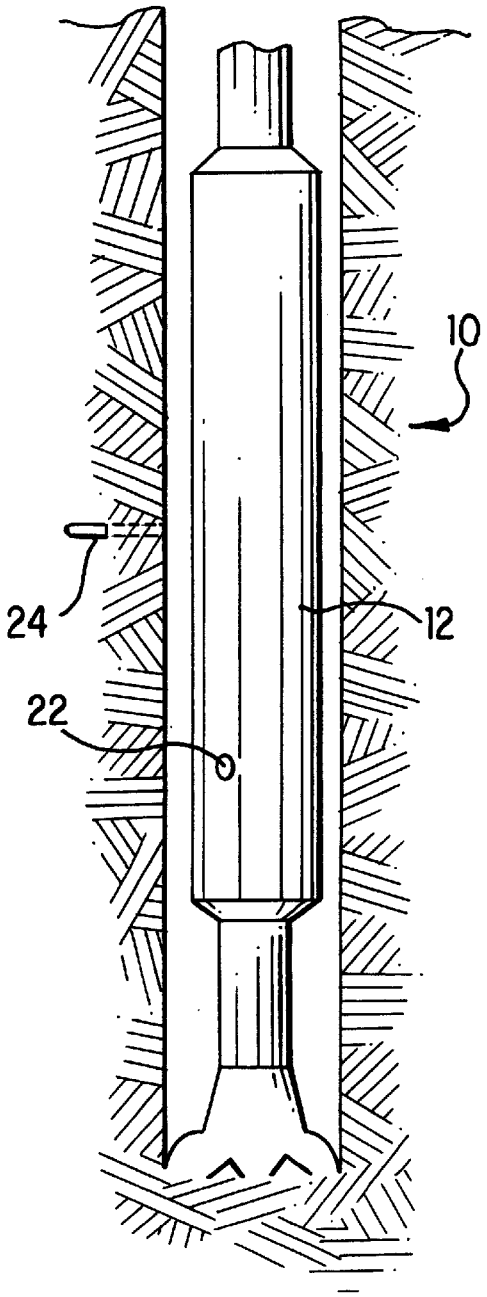
FIG. 1 is a diagram of a drill collar positioned in a borehole following the deployment of an sensor apparatus from the drill collar in accordance with the present invention.
Figure 2:
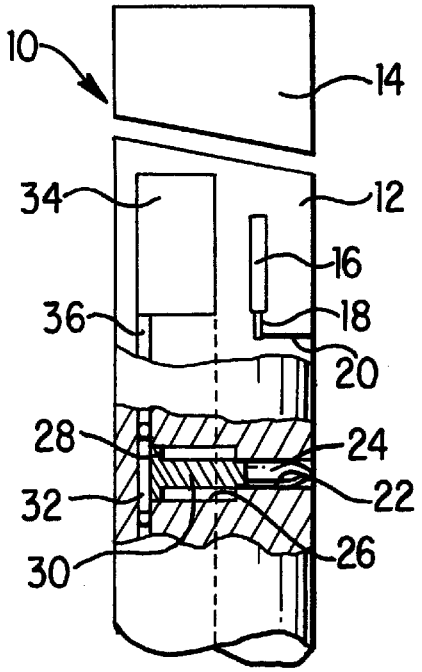
FIG. 2 is a schematic illustration of the drill collar having a hydraulically energized system for forcibly inserting the intelligent sensor apparatus from the borehole into a selected subsurface formation.
Figure 3:
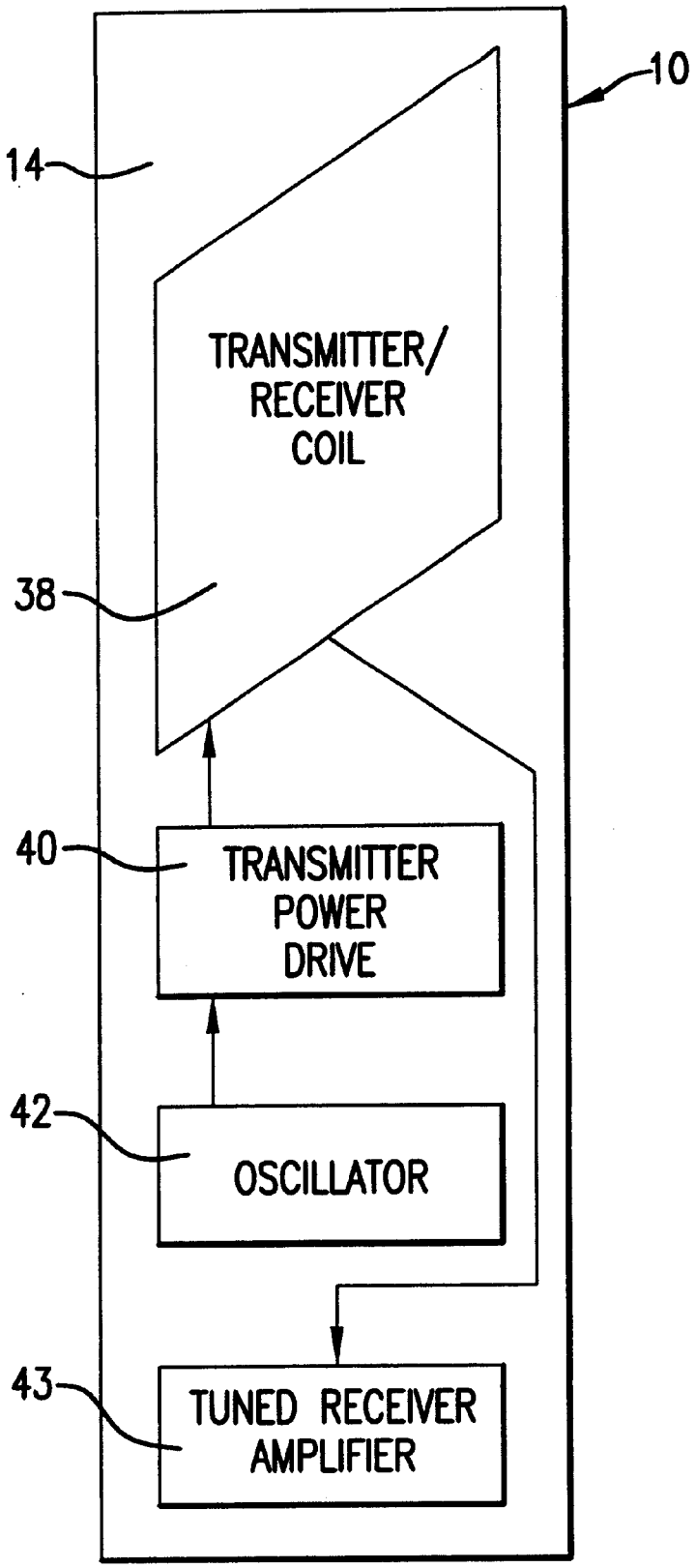
FIG. 3 is an electronic block diagram schematically representing a drill collar having a power cartridge therein provided with electronic circuitry for receiving formation data signals from the remotely deployed formation sensor apparatus.

U.S. patent application Ser. No. 09/019,466, also assigned to the assignee of the present invention, describes a method and apparatus for deploying intelligent sensor apparatuses containing data sensors, such as pressure sensors, from a drill collar in the drill string into the subsurface formation beyond the wellbore while drilling operations are being performed. The method and apparatus of the '166 application will now be described as they relate to the present invention. Referring first to FIGS. 1–3, a drill collar being a component of a drill string for drilling a wellbore is shown generally at 10 and represents the preferred embodiment of the invention of the '466 application. The drill collar is provided with a an enlarged-diameter cylindrical section 12 having a power cartridge 14 (See FIG. 2) incorporating the transmitter/receiver circuitry shown in FIG. 3. Drill collar 10 is also provided with pressure gauge 16 having its pressure sensor 18 exposed to borehole pressure via a drill collar passage 20. The pressure gauge senses ambient hydrostatic borehole pressure at the depth of a selected subsurface formation and is used to verify pressure calibration of intelligent sensor apparatuses. Electronic signals representing ambient wellbore pressure are transmitted via pressure gauge 16 to the circuitry of power cartridge 14 which, in turn, accomplishes pressure calibration of the intelligent sensor apparatus being deployed at that particular wellbore depth. Drill collar 10 is also provided with one or more remote sensor receptacles 22 each containing at least one intelligent sensor apparatus 24 for positioning within a selected subsurface formation of interest which is intersected by the wellbore being drilled.

Sensor apparatus 24 includes encapsulated data sensors which are moved from the drill collar to a position within the formation surrounding the borehole for sensing formation parameters such as pressure, temperature, rock permeability, porosity, conductivity, and dielectric constant, among others. The data sensors are appropriately encapsulated in a sensor housing of sufficient structural integrity to withstand damage during movement from the drill collar into laterally embedded relation with the subsurface formation surrounding the wellbore, as will be described further below.

Those skilled in the art will appreciate that such lateral embedding movement need not be perpendicular to the borehole, but may be accomplished through numerous angles of attack into the desired formation position. Sensor deployment can be achieved by utilizing one or a combination of the following: (1) drilling into the borehole wall and placing the sensor into the formation; (2) punching/pressing the encapsulated sensors into the formation with a hydraulic press or mechanical penetration assembly; or (3) shooting the encapsulated sensors into the formation by utilizing "firing" or ignition-induced propellant charges.

FIG. 2 displays hydraulically energized ram 30 which is employed in one embodiment to deploy sensor apparatus 24 and to cause its penetration into the subsurface formation to a sufficient position outwardly from the borehole that it senses selected parameters of the formation. For sensor deployment, the drill collar is provided with internal cylindrical bore 26 within which is positioned piston element 28 having ram 30 that is disposed in driving relation with intelligent sensor apparatus 24. Piston 28 is exposed to hydraulic pressure that is communicated to piston chamber 32 from hydraulic system 34 via hydraulic supply passage 36. The hydraulic system is selectively activated by power cartridge 14, so that the remote sensor can be calibrated with respect to ambient borehole pressure at formation depth prior to deployment, as indicated above, and can then be moved from receptacle 22 into the formation beyond the borehole wall so that formation pressure parameters will be free from borehole effects.

Referring now to FIG. 3, power cartridge 14 of drill collar 10 incorporates at least one transmitter/receiver coil 38 having transmitter power drive 40 in the form of a power amplifier having its frequency F determined by oscillator 42. The drill collar power cartridge is also provided with tuned receiver amplifier 43 that is set to receive signals at a frequency 2F which will be transmitted to the drill collar by intelligent sensor apparatus 24, also known as the "smart bullet," as will be explained below.

Figure 4:
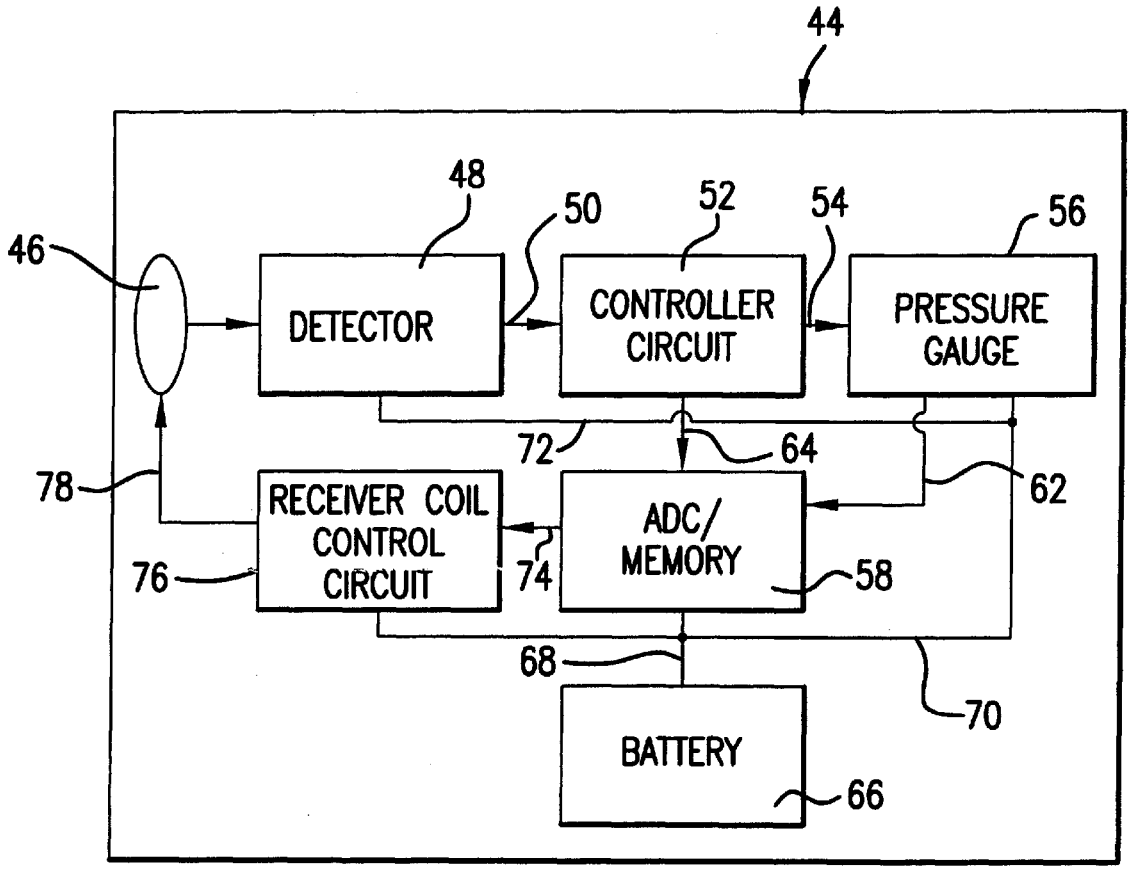
FIG. 4 is an electronic block diagram schematically showing the intelligent sensor apparatus which senses one or more formation data parameters such as pressure, temperature, and rock permeability, stores the data in memory, and, upon instruction, transmits the stored data to the circuitry of the power cartridge of the drill collar shown in FIG. 4.

FIG. 4 illustrates the electronic circuitry of sensor apparatus 24 in the form of a block diagram generally referenced as 44. This circuitry includes at least one transmitter/receiver coil 46, for example, a radio frequency ("RF") antenna, with the receiver thereof providing output 50 from detector 48 to controller circuit 52. The controller circuit is provided with one of its controlling outputs 54 being fed to pressure gauge or sensor 56 so that the gauge output signals will be conducted to analog-to-digital converter ("ADC")/memory 58, which receives signals from the pressure gauge via conductor 62 and also receives control signals from controller circuit 52 via conductor 64. Battery 66 is provided within sensor apparatus circuitry 44 and is coupled with the various circuitry components of the sensor by power conductors 68, 70 and 72. Memory output 74 of ADC/memory circuit 58 is fed to receiver coil control circuit 76. Receiver coil control circuit 76 functions as a driver circuit via conductor 78 for transmitter/receiver coil 46 to transmit data to drill collar 12.

Figure 5:
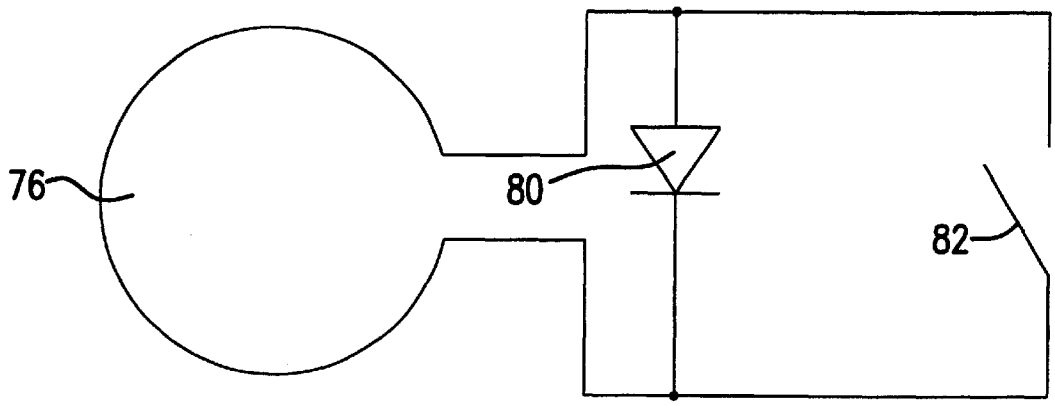
FIG. 5 is an electronic block diagram schematically illustrating the receiver coil circuit of the intelligent sensor apparatus.

Referring now to FIG. 5, low threshold diode 80 is shown connected across receiver coil control circuit 76. Under normal conditions, and especially in the dormant or "sleep" mode, electronic switch 82 is open, minimizing power consumption. When receiver coil control circuit 76 becomes activated by the drill collar's transmitted electromagnetic field, a voltage and a current is induced in the receiver coil control circuit. At this point, however, diode 80 will allow the current to flow only in one direction. This non-linearity changes the fundamental frequency F of the induced current shown at 84 in FIG. 6 into a current having the fundamental frequency 2F, in other words, twice the frequency of electromagnetic transmitter wave 84, as shown at receiver wave 86.

Throughout the complete transmission sequence, transmitter/receiver coil 38, shown in FIG. 3, is also used as a receiver and is connected to a receiver amplifier 43 which is tuned at the 2F frequency. When the amplitude of the received signal is a maximum, this indicates that sensor apparatus 24 is located in close proximity for optimum transmission between drill collar and the remotely deployed sensor apparatus.

Sensor

Successful ballistic deployment of electronic sensor apparatus 24 into the rock formation is only possible when a variety of constraints are met. For successful deployment, the sensor apparatus must: survive both the launch and impact in the rock formation without substantial deformations, breakage on the outside, or disintegration of any internal component; ensure sufficient and straight penetration into all types of reservoir rock which are normally encountered in oilwell formations; and be capable of RF or other wireless communication through the rock formation and back to the data processing equipment in the borehole.

Figure 7:
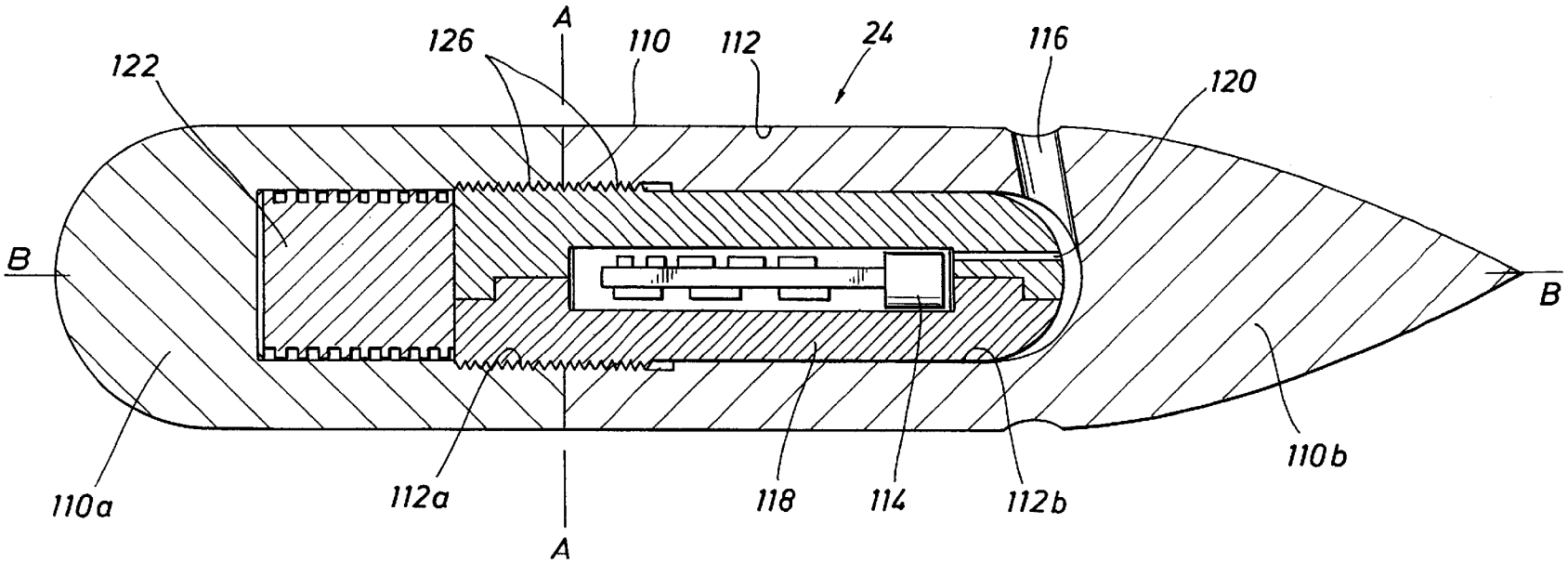
FIG. 7 is a detailed diagram of the intelligent sensor apparatus of the present invention, taken in section.

Referring now FIG. 7, intelligent sensor apparatus 24 is illustrated as including shell 110 having chamber 112 therein and adapted for sustaining forcible propulsion into a subsurface formation (shown generally in FIG. 1). Data sensor 114 and associated electronics are disposed within chamber 112 of shell 110 in a manner that is described further below. The shell has first port 116 therein for communicating properties of a fluid present in the subsurface formation to data sensor 114 when sensor apparatus 24 is positioned in the subsurface formation, whereby the data sensor senses at least one of the properties of the fluid.

Depending on the type of application and data sensors inside shell 110, there may be a plurality of ports 116 in nose section 110*b* right behind the nose cone and as far forward as possible so as to remove the ports from borehole effects at the rear of sensor apparatus 24. Through these ports, a variety of measurements can be conducted. Examples are the chemical analysis of liquids and solids, pore fluid pressure, and resistivity measurements, among others. These ports are preferably covered with either a metal band having small strainer holes therein, such as band 131 shown in broken lines in FIG. 8B, or a porous coating such as a ceramic coating. The use of a plurality of such ports, as opposed to a single port, decreases the likelihood of inoperability due to port plugging in the formation. No ports or openings are necessary for sensor apparatuses containing only accelerometers or those used for nuclear magnetic resonance measurements, which uses are also contemplated by the present invention.

General ballistics principles help determine the essential projectile parameters for sensor apparatus 24, such as required speed and weight to achieve sufficient penetration, length/cross-section ratio to ensure straight flight, and nose shape for optimum penetration depth. Shell 110 is therefore substantially bullet-shaped and is elongated about axis B—B to partially satisfy the second constraint (sufficient, straight penetration) expressed above.

Figure 8B:
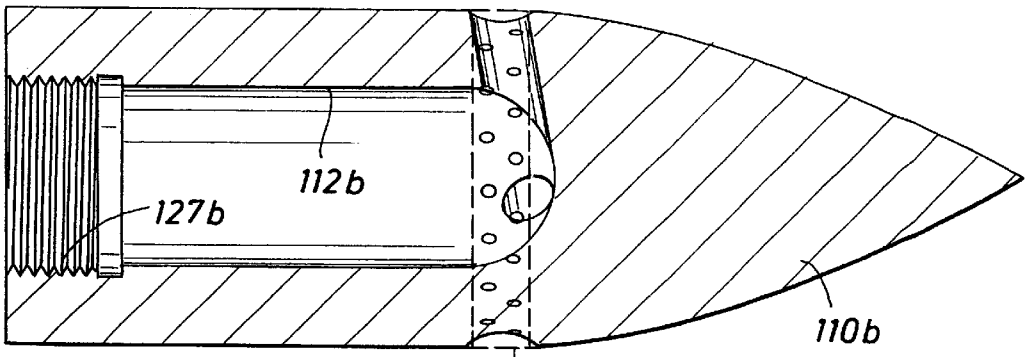
FIG. 8B is a sectional view of the nose section of the outer shell.
Figure 8A:
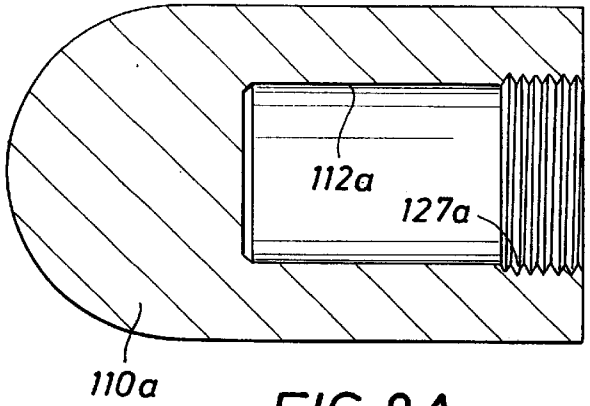
FIG. 8A is a sectional view of the rear section of the outer shell of the sensor apparatus.

Unlike standard projectiles which consist of a single solid piece of material, a bullet apparatus such as apparatus 24 containing a sensor and associated electronics requires at least one rather large assembly opening. Thus, shell 110 is split along a first plane A—A perpendicular to its longitudinal axis B—B into a nose section 110*b* and a rear section 110*a*. The shell sections each have opposing cavities 112*b* and 112*a*, respectively, as seen in FIGS. 7, 8A, and 8B, that cooperate to form chamber 112 when the nose and rear sections are connected.

In addition to the projectile parameters discussed above, shell 110 must satisfy the requirement for overall shell toughness. A Tungsten-Nickel-Iron alloy is presently preferred for shell nose section 110*b*, which satisfies the launch/impact survival constraint expressed above. In this manner, shell 110 is adapted for sustaining the high g-forces (85,000 g's or higher) experienced by sensor apparatus 24 along its longitudinal axis B—B during deployment.

Figure 9:
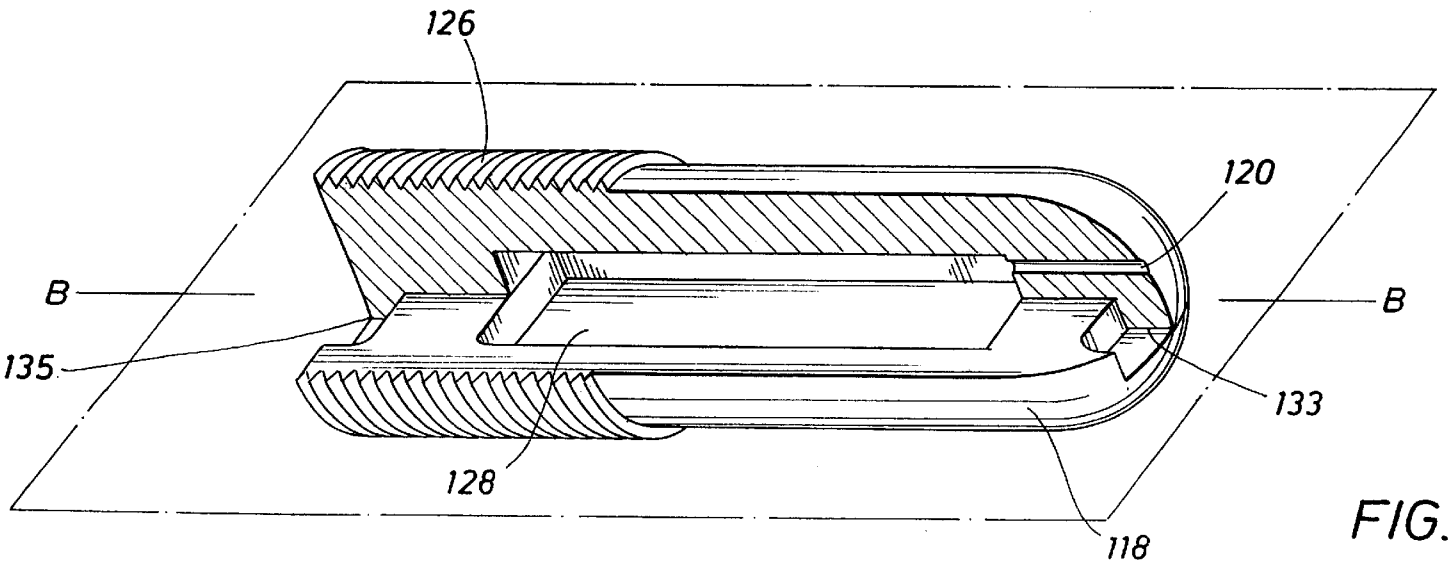
FIG. 9 is an orthogonal projection of the inner electronics capsule of the sensor apparatus, shown in three-quarter section.

For a multi-component shell such as shell 110, deployment launch and impact shock waves are transmitted across contact areas between materials with different elasticity coefficients. This causes shock wave reflections across shell section 110*a* and 110*b* (which are substantially constructed of dissimilar materials), and can lead to local material failure or separation of the sections. To reduce local stress in the contact areas and obtain a better shock transfer, an encapsulated interior design structure was developed as shown in FIG. 9.

The entire data sensor and electronics assembly, except the antenna, is disposed in cavity 128 inside split Titanium-alloy capsule 118. This capsule has two functions. First, it supports and protects the fragile electronics and data sensor parts in cavity 128 by effectively combining the parts into one solid piece. Second, it acts as a brace for nose and rear shell sections 110*b,* 110*a.* The shell sections become centralized along the same longitudinal axis (axis B—B), and their respective perpendicular rear and front surfaces make a controlled contact at plane A—A. Part of the overall shock forces are thus transmitted and dampened by the inner capsule 118.

Capsule 118 is equipped with outer threaded section 126 to lock it firmly against two complementary inner threaded sections 127*a,* 127*b* in chambers 112*b* and 112*a* of shell sections 110*b* and 110*a,* respectively, as seen in FIGS. 7, 8A, and 8B. Appropriate potting is provided in chamber 112 for sealing against unwanted fluid entry into the electronics section.

As mentioned elsewhere, data sensor 114 is carried within capsule 118 disposed within the chamber of shell 110. Capsule 118 extends from chamber 112*b* in nose section 110*b* into chamber 112*a* in rear section 110*a,* whereby the capsule spans first plane A—A and integrates the nose and rear sections of shell 110. The capsule is split substantially along a second plane C that includes the capsule's longitudinal axis (axis B—B, when placed in cavity 128) to facilitate placement of data sensor 114 therein. The split portions of capsule 118 further include respective complementary forward and rearward components, referred to generally at 133 and 135 in FIG. 9, for properly engaging and aligning the split portions of the capsule prior to placement in chamber 112.

The capsule is further equipped with a second port 120 therein, and is disposed within chamber 112 of shell 110 so as to position the second port adjacent first port 116, as shown in FIG. 7. This enables communication of the formation fluid properties through the first and second ports to data sensor 114 when the sensor is positioned in the subsurface formation. Data sensor 114 is preferably adapted for sensing at least formation pressure and temperature, and may include a number of discrete sensors.

To communicate with a remote station via RF signals, an antenna must also be part of the sensor apparatus. This antenna needs to be protected against the burn chamber pressure and temperature, assuming the sensor apparatus is deployed via an ignition-induced propulsive force (in other words, "fired"), as well as protected from all impact forces. To accommodate all these constraints, a RF translucent rear cap made of Transition Toughened Zirconia ("TTZ") ceramic was developed. FIG. 7 thus illustrates intelligent sensor apparatus 24 equipped with antenna 122 disposed within rear chamber section 112*a* for transmitting signals representative of the fluid property sensed by data sensor 114, and for receiving signals from a remote source such as a drill collar to activate the data sensor. Antenna 122 includes transmitter/receiver coil 46, shown schematically in FIG. 4.

Operation

The deployment and operation of intelligent sensor apparatus 24 will now be summarized. The intelligent sensor apparatus includes a substantially bullet-shaped shell 110 equipped with encapsulated data sensor 114 for indicating a property of a subsurface formation, as well as a receiver for receiving remotely transmitted signals and a transmitter for transmitting a signal representative of the sensor-indicated property. Sensor apparatus 24 is positioned within a drill collar of a drill string disposed in a wellbore penetrating the subsurface formation.

Th present invention also contemplates the deployment of intelligent sensor apparatus 24 from a wireline tool, even though the description that follows is limited to deployment from the drill collar of a drill string.

Figure 6:
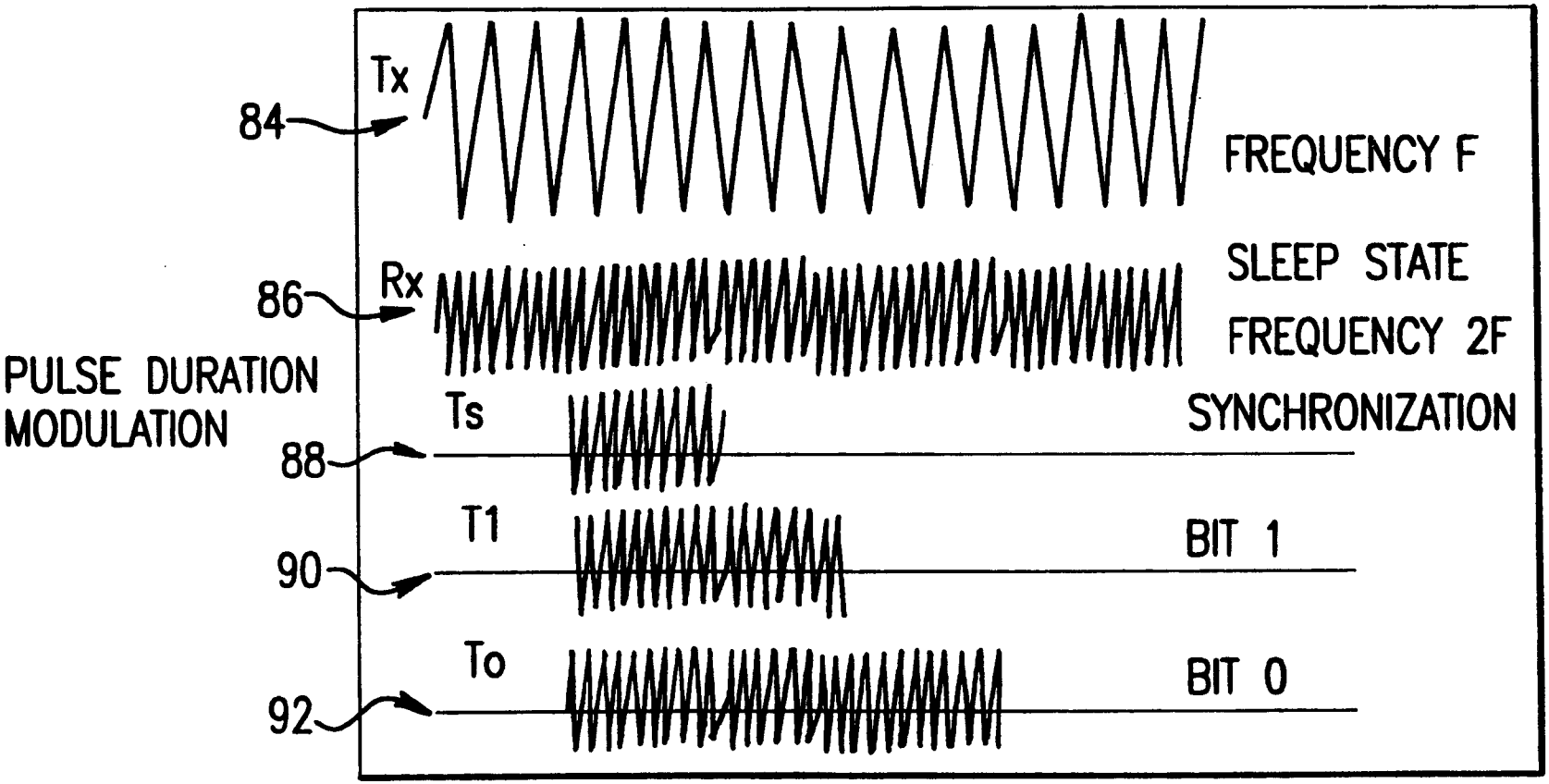
FIG. 6 is a transmission timing diagram showing pulse duration modulation of radio frequency communications between the drill collar and the remotely deployed sensor apparatus.

Force is applied from the drill string to move the apparatus 24 from the drill collar into the subsurface formation. Once the intelligent sensor apparatus, or "smart bullet" as it is also called, is in place inside the formation to be monitored, the sequence in which the transmission and the acquisition electronics function in conjunction with drilling operations is as follows:

The drill collar (or other downhole tool apparatus) equipped with acquisition sensors is positioned in close proximity of the intelligent sensor apparatus 24. An electromagnetic wave at a frequency F, as shown at 84 in FIG. 6, is transmitted from drill collar transmitter/receiver coil 38 to 'switch on' the intelligent sensor apparatus, also referred to as the target, and to induce the sensor apparatus to send back an identifying coded signal. The electromagnetic wave initiates the remotely deployed sensor apparatus's electronics to go into the acquisition and transmission mode, and pressure data and other data representing selected formation parameters, as well as the sensor's identification code, are obtained at the remote sensor apparatus's level.

In a particular embodiment, intelligent sensor apparatus 24 performs a formation pressure measurement. For this function, a pressure/temperature sensor is located in the front of electronics capsule 118. Hydraulic communication between this sensor and the formation fluids is achieved through communication ports 116 and 120. The internal space around the pressure sensor and the communication ports is filled with a non-conductive hydraulic fluid. The actual hydraulic orifice, port 116, contains a filter made out of either a ceramic or metal filter material. This provides both a flow restriction against filler fluid loss during deployment, and also acts as filter once formation liquids are in contact with the port openings.

The presence of the target, in other words, the remote sensor, is detected by the reflected wave scattered back from the target at a frequency of 2F as shown at 86 in the transmission timing diagram of FIG. 6. At the same time pressure gauge data (pressure and temperature) and other selected formation parameters are acquired, and the electronics of sensor apparatus 24 convert the sensed formation data into one or more serial digital signals. This digital signal or signals, as the case may be, is transmitted from remotely deployed sensor apparatus 24 back to the drill collar via transmitter/receiver coil 46 in antenna 122. This is achieved by synchronizing and coding each individual bit of data into a specific time sequence during which the scattered frequency will be switched between F and 2F.

For example, time sequence 88 is interpreted as a synchronization command having a duration $T_S$. Time sequences 90, 92 are interpreted as Bit 1 and Bit 0 having durations $T_1$ and $T_0$, respectively. Data acquisition and transmission is terminated after stable pressure and temperature readings have been obtained and successfully transmitted to the on-board circuitry of the drill collar 10.

Whenever the sequence above is initiated, transmitter/receiver coil 38 located within the drill collar is powered by the transmitter power drive or amplifier 40. An electromagnetic wave is transmitted from the drill collar at a frequency F characterized by oscillator 42, as indicated in the timing diagram of FIG. 6 at 84. The frequency F can be selected within the range from 100 KHz up to 500 MHz. As soon as the target comes within the zone of influence of the collar transmitter, receiver coil 46 located within antenna 122 of smart bullet 24 will radiate back an electromagnetic wave at twice the original frequency by means of receiver coil control circuit 76 and transmitter/receiver coil 46.

In contrast to present day operations, the present invention makes pressure data and other formation parameters available while drilling, and, as such, allows well drilling personnel to make decisions concerning drilling mud weight and composition as well as other parameters at a much earlier time in the drilling process without necessitating the tripping of the drill string for the purpose of running a formation tester instrument. The present invention requires very little time to perform the actual formation measurements. Once a remote sensor is deployed, data can be obtained while drilling, a feature that is not possible according to known well drilling techniques.

Time dependent pressure monitoring of penetrated wellbore formations can also be achieved as long as pressure data from the pressure sensor 18 is available. This feature is dependent of course on the communication link between the transmitter/receiver circuitry within the power cartridge of the drill collar and any deployed intelligent remote sensors.

The intelligent sensor apparatus output can also be read with wireline logging tools during standard logging operations. This feature of the invention permits varying data conditions of the subsurface formation to be acquired by the electronics of logging tools in addition to the real time formation data that is now obtainable from the formation while drilling.

By positioning intelligent sensor apparatus 24 remotely beyond the immediate borehole environment, at least in the initial data acquisition period there will be no borehole effects on the pressure measurements taken. As no liquid movement is necessary to obtain formation pressures with in-situ sensors, it will be possible to measure formation pressure in non-permeable rocks. Those skilled in the art will appreciate that the present invention is equally adaptable for measurement of several formation parameters, such as permeability, conductivity, dielectric constant, rock strength, and others, and is not limited to formation pressure measurement.

Furthermore, it is contemplated by and within the scope of the present invention that the remote sensors, once deployed, may provide a source of formation data for a substantial period of time. For this purpose, it is necessary that the positions of the respective sensors be identifiable. Thus, in one embodiment, the remote sensors will contain radioactive "pip-tags" that are identifiable by a gamma ray sensing tool or sonde together with a gyroscopic device in a tool string that enhances the location and individual spatial identification of each deployed sensor in the formation.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. An apparatus for gathering data from a subsurface formation, comprising:

a shell having a chamber therein and adapted for sustaining forcible propulsion into a subsurface formation from a wellbore;

a data sensor disposed within the chamber of said shell;

said shell having a first port therein for communicating properties of a fluid present in the subsurface formation to said data sensor when said apparatus is positioned in the subsurface formation, whereby said data sensor senses at least one of the properties of the fluid; and an antenna disposed within said chamber for transmitting signals representative of the fluid property sensed by said data sensor.

2. The apparatus of claim 1, wherein said data sensor is carried within a capsule disposed within the chamber of said shell.

3. The apparatus of claim 1, wherein said shell is substantially bullet-shaped.

4. The apparatus of claim 1, wherein said shell includes a nose section substantially constructed of a first material and a rear section substantially constructed of a second material.

5. The apparatus of claim 4, wherein the first material is a tungsten alloy.

6. The apparatus of claim 4, wherein the second material is a zirconia-based ceramic.

7. The apparatus of claim 1, wherein said antenna is also capable of receiving signals from a remote source to activate said data sensor.

8. The apparatus of claim 1, wherein said antenna is disposed in a rear portion of the chamber and said data sensor is disposed in a forward portion of said chamber.

9. The apparatus of claim 2, wherein said shell is split along a first plane perpendicular to its longitudinal axis into a nose section and a rear section each having opposing cavities that cooperate to form the chamber in said shell when the nose and rear sections are connected; and said capsule extends from the chamber in the nose section into the chamber in the rear section, whereby said capsule spans the first plane and integrates the nose and rear sections of said shell.

10. The apparatus of claim 9, wherein said capsule is split along a second plane that includes said capsule's longitudinal axis.

11. The apparatus of claim 9, wherein said antenna is disposed behind said capsule in the chamber in the rear section of said shell for transmitting signals representative of the property sensed by said data sensor.

12. The apparatus of claim 2, wherein said capsule has a second port therein and said capsule is disposed within the chamber of said shell so as to position the second port adjacent the first port, enabling communication of the formation fluid properties through the first and second ports to said data sensor when said apparatus is positioned in the subsurface formation.

13. The apparatus of claim 1, wherein the data sensor is adapted for sensing formation pressure.

14. The apparatus of claim 13, further comprising a second data sensor disposed within the chamber of said shell for sensing formation temperature.

15. An apparatus for remotely deploying a sensor into a subsurface formation for gathering data from the formation, comprising:

a shell having a chamber therein and adapted for sustaining forcible propulsion into a subsurface formation from a wellbore;

said shell having a first port therein for communicating properties of a fluid present in the subsurface formation to the chamber, whereby a sensor disposed in said chamber could sense at least one of the properties of the fluid; and an antenna disposed within said chamber for transmitting signals representative of the fluid property sensed by a data sensor disposed in said chamber.

16. The apparatus of claim 15, wherein said shell is adapted for sustaining g-forces of at least 85,000 g's during deployment of the apparatus along its longitudinal axis.

17. The apparatus of claim 15, further comprising a capsule disposed within the chamber of said shell, said capsule having a sensor carried therein for sensing at least one of the properties of the formation.

18. The apparatus of claim 17, wherein said capsule is at least partially constructed of a titanium alloy.

19. The apparatus of claim 17, wherein said shell is split along a first plane perpendicular to its longitudinal axis into a nose section and a rear section each having opposing cavities that cooperate to form the chamber in said shell when the nose and rear sections are connected; and said capsule extends from the chamber in the nose section into the chamber in the rear section, whereby said capsule spans the first plane and integrates the nose and rear sections of said shell.

20. The apparatus of claim 19, wherein the nose section of said shell is substantially constructed of a tungsten alloy.

21. The apparatus of claim 19, wherein the rear section of said shell is adapted for protecting components disposed within the chamber in said shell from high temperatures and pressures encountered during deployment of the apparatus.

22. The apparatus of claim 21, wherein the rear section of said shell is substantially constructed of a zirconia-based ceramic.

23. A method of determining a property of a subsurface formation, comprising the steps of:

equipping a shell with a sensor for indicating a property of a subsurface formation and an antenna for transmitting a signal representative of the sensor-indicated property, the shell having a port therein for communicating properties of the fluid present in the subsurface formation to the sensor when the shell is inserted into the subsurface formation;

positioning the shell within a downhole tool disposed in a wellbore penetrating the subsurface formation;

applying force from the downhole tool to move the shell from the downhole tool into the subsurface formation;

sensing a formation property with the sensor; and transmitting a signal representative of the formation property with the antenna.

24. A method of determining a property of a subsurface formation, comprising the steps of:

equipping a substantially bullet-shaped shell with a sensor for indicating a property of a subsurface formation, a receiver for receiving remotely transmitted signals, and a transmitter for transmitting a signal representative of the sensor-indicated property, the shell having a port therein for communicating properties of the fluid present in the subsurface formation to the sensor when the shell is inserted into the subsurface formation;

positioning the shell within a drill string disposed in a wellbore penetrating the subsurface formation;

applying force from the drill string to move the shell from the drill string into the subsurface formation;

activating the sensor with a remote signal transmitted to the receiver;

sensing a formation property with the sensor; and transmitting a signal representative of the formation property with the transmitting means.

25. The method of claim 24, wherein the force applied to the shell is an ignition-induced propulsive force.

26. The method of claim 25, wherein the force applied to the shell is substantially a mechanical force.

* * * * *